United States Patent [19]

Smith

[11] 4,433,715

[45] Feb. 28, 1984

[54] MODULAR APPARATUS FOR CASTING METAL STRIP

[75] Inventor: Robert W. Smith, Long Valley, N.J.

[73] Assignee: Allied Corporation, Morris Township, Morris County, N.J.

[21] Appl. No.: 366,941

[22] Filed: Apr. 9, 1982

Related U.S. Application Data

[63] Continuation-in-part of Ser. No. 152,208, May 21, 1980, abandoned.

[51] Int. Cl.[3] ..... B22D 11/00

[52] U.S. Cl. ..... 164/423; 164/437

[58] Field of Search ..... 164/423, 337, 437, 438, 164/439–440; 222/591–607

[56] References Cited

U.S. PATENT DOCUMENTS

| | | | |
|---|---|---|---|
| 3,083,422 | 4/1963 | Finkl | 222/603 X |
| 3,558,256 | 1/1971 | Bick et al. | 164/438 X |
| 3,567,082 | 3/1971 | Tinnes | 222/593 X |
| 3,568,756 | 3/1971 | Dain | 164/440 |
| 3,663,730 | 5/1972 | Gates | 222/602 X |
| 3,679,105 | 7/1972 | Ratcliffe | 164/337 X |
| 3,730,401 | 5/1973 | Bode, Jr. | 164/337 X |
| 3,964,535 | 6/1976 | Bedell et al. | 164/423 X |
| 4,154,380 | 5/1979 | Smith | 164/423 X |

*Primary Examiner*—Kuang Y. Lin

*Attorney, Agent, or Firm*—James Risenfeld; Gerhard H. Fuchs

[57] ABSTRACT

A modular apparatus is provided for depositing molten metal onto a movable chill surface to form continuous strip. The apparatus includes a crucible, consisting of a receptacle, sealed at one end to a base, and a heater for maintaining metal in the molten state in the receptacle. A simple nozzle conveys the molten metal from the crucible into contact with the chill surface. The individual elements of the apparatus may be replaced without replacing the remaining elements, and the nozzle may be replaced while a charge of molten metal is in the crucible.

4 Claims, 5 Drawing Figures

MODULAR APPARATUS FOR CASTING METAL STRIP

DESCRIPTION

CROSS-REFERENCE TO PRIOR APPLICATION

This application is a continuation-in-part of application Ser. No. 152,208, filed May 21, 1980, and now abandoned.

BACKGROUND OF THE INVENTION

1. Field of the Invention

This invention relates to apparatus for casting metal strip, particularly strip of metallic glass alloys.

2. Description of the Prior Art

For purposes of the present invention, a strip is a slender body whose transverse dimensions are much less than its length, including wire, ribbon, filament and sheet, of regular or irregular cross section.

Methods for making metal strip directly from the molten metal are known. These may involve, for example, jetting molten metal through an orifice and cooling the metal, either in free flight or by contact with a chill body, to obtain continuous strip. Typically, the molten metal is pressurized in a crucible, which has at its bottom a casting nozzle having an orifice in the shape of the desired cross section of the metal jet. Usually, the orifice of the casting nozzle is small, on the order of about 0.2 mm to about 1.0 mm diameter, and plugs easily in operation. Unplugging is not simple, since a body of molten metal is maintained above the orifice. Another method for making metal strip directly from the melt is the "planar flow casting" (PFC) method disclosed in U.S. Pat. No. 4,142,571, issued Mar. 6, 1979, to Narasimhan. This patent discloses apparatus which comprises a movable chill body, a slotted nozzle in communication with a reservoir for holding molten metal and means for effecting expulsion of the molten metal from the reservoir through the nozzle and onto the moving chill surface. The slotted nozzle is located in close proximity to the chill surface. The nozzle of the PFC method not only has the plugging problems indicated above, but it must also be precisely oriented relative to the chill surface.

In casting processes of the types mentioned, as well as in other metal casting processes, it is convenient to be able to replace the casting nozzle while maintaining a charge of molten metal in the crucible. The advantages of an externally replaceable nozzle were recognized in U.S. Pat. No. 4,154,380, issued May 15, 1979, to R. W. Smith. That patent discloses a casting nozzle comprising three elements, including a nozzle body, a replaceable orifice member and retaining means for holding the orifice member in sealing engagement with the nozzle body. A simpler design for an externally replaceable nozzle is desirable.

U.S. Pat. No. 3,679,105, issued July 25, 1972, to Ratcliffe, discloses a nozzle arrangement for a molten metal container vessel that allows installation of the nozzle from outside the vessel. However, that arrangement is not adapted for replacing the nozzle while the vessel contains molten metal.

In both the Smith and the Ratcliffe designs, the nozzle is rigidly secured to the molten metal container vessel by a screw arrangment. Since the vessel must be of a refractory material, not easily machined, the need to drill and tap into the vessel is an undesirable feature. In addition, thermal expansion can cause a change in the orientation of the nozzle during heating. If the materials of the nozzle and vessel are different, thermal expansion could also cause large stresses and consequent failure of the nozzle, the vessel or both.

SUMMARY OF THE INVENTION

In accordance with the present invention, there is provided a modular apparatus for casting molten metal onto a movable chill surface to form continuous strip. The apparatus comprises in combination a crucible for holding the molten metal, heating means, means for stopping molten metal flow out of the crucible with or without the nozzle in place, a nozzle, and resilient nozzle support means. The crucible comprises a receptacle having two open ends and a base adapted for sealing engagement with a first end of the receptacle and having a through passage. The heating means are adapted for maintaining the metal in the molten state in the recepacle. The nozzle has one end adapted for sealing engagement with the base and provides, in communication with the through passage, a conduit for passing molten metal from the crucible into contact with the chill surface.

For convenience, the apparatus is described as if it were oriented vertically, with the chill surface located below the crucible and nozzle; however, as is clear to one skilled in the art, the apparatus may also be oriented with the chill surface positioned horizontally adjacent to or even above the nozzle.

The present invention is particularly well adapted for use in PFC, where optimum results depend on the ability to maintain a casting nozzle precisely oriented relative to the chill surface.

DETAILED DESCRIPTION OF THE INVENTION

Figure 1:
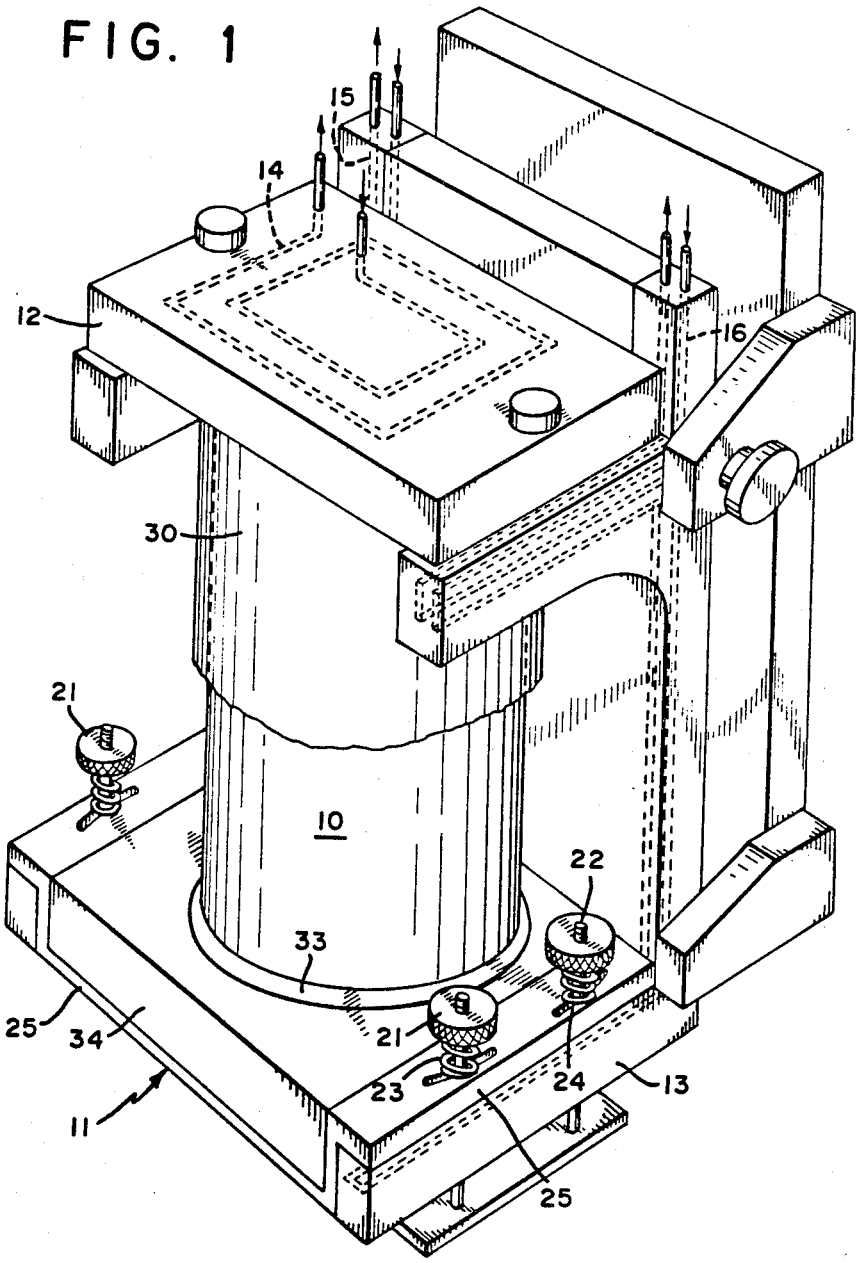
FIG. 1 is a perspective view of a casting apparatus of the present invention.

This invention provides a modular casting system comprising a crucible, heating means, and nozzle, each of whose individual elements may be replaced without replacing the remaining elements. The crucible consists of a receptacle in sealing engagement with a base and is provided with heating means. Typically, the receptacle has cylindrical walls oriented substantially vertically, thus having a circular cross section in a horizontal plane. The receptacle cross section may, however, be elliptical, rectangular, or of irregular shape and may be different for different planes along its length. The heating means may be a conventional induction heater comprising current-carrying coils surrounding the receptacle and supported on the base. The nozzle is in sealing engagement with the base and may be replaced while a charge of molten metal is in the crucible, using means for interrupting flow from the crucible with and without the nozzle in place. The nozzle support is resilient and provides a controlled loading force at the seal between the nozzle and base. Springs are convenient means for providing this controlled force.

In a preferred embodiment of the invention, the crucible and nozzle are supported separately; i.e., the nozzle may be removed while the crucible (and heater) remain supported. Separate supports permit one to adjust the nozzle position relative to the plane of the chill surface to facilitate flow control. The modular construction of the casting apparatus, together with the resilient nozzle support, provide design and functional advantages in the areas of durability, thermal shock resistance, flow control, structural integrity and material selection that monolithic versions with rigid nozzle supports cannot offer.

The apparatus of this invention is suitable for use in jet casting, PFC and other casting methods known in the art. It is generally desirable to maintain an atmosphere of an inert gas, such as argon, over the molten metal in the crucible. To facilitate this, the crucible preferably has a cap in sealing engagement with the top of the receptacle, and the cap has at least one through passage to permit controlled gas flow into and out of the crucible. In order to facilitate continuous casting, the cap may have a through passage to permit inroduction of additional metal into the crucible during casting. The additional metal may first be melted in an auxiliary vessel prior to its being added to the crucible or it may be added in solid - for example, "shot" - form. Preferably, the cap includes channels through which a cooling fluid, such as water, may be passed.

The seal between the receptacle and cap is a gas-tight seal, generally including an o-ring seal, gasket or the like. The seal between the receptacle and base is adapted to contain molten metal, whose surface tension generally premits a gasket-free seal. Both seals are provided with a controlled loading force by the crucible support. A single set of springs may provide the controlled force at both ends of the receptacle.

Molten metal generally has a corrosive effect on the materials it contacts. Thus, to the extent possible, it is desirable to choose crucible and nozzle materials that do not react with the molten metal. Moreover, they should resist high temperatures and thermal shock and permit fabrication without undue difficulty. Alternatively, these materials should be inexpensive and easily replaced. The present invention provides a simple and inexpensive nozzle, which can be molded as a single piece. In addition, the useful lifetime of the receptacle may be extended by using a design that is reversible end-for-end. Thus, when the lower end, and particularly the seal to the base, becomes worn, the receptacle may be reversed. By using a gasket, such as an o-ring seal, between the upper end of the receptacle and the cap, a receptacle surface that does not permit adequate sealing to the base (without a gasket) may nevertheless permit adequate sealing to the cap after end-for-end reversal.

Suitable crucible and nozzle materials include quartz, boron nitride, aluminum oxide, graphite and other refractory materials. The elements of the crucible and the nozzle may be of the same material or of different materials. For example, crucible material may be selected for thermal shock or insulation properties and nozzle material for wearability. The base and receptacle need not be of the same material.

If, as is often the case, there is little or no contact between cap and molten metal, the cap may be of aluminum or other metal, particularly if it includes cooling means. In a simple embodiment, the cap may comprise a metal plate of rectangular or circular cross section.

The nozzle is designed to seal on the underside of the base without the need for gasketing, although gaskets may be used if desired. In one embodiment, the sealing surface of the nozzle is tapered, and the alignment of the nozzle passage is consequently fixed relative to the base. In an alternative embodiment, the nozzle-base seal is a ball-and-socket joint, which permits the nozzle passage to be tilted relative to the base.

Tapered nozzle-base sealing surfaces and spring-loading of the seal accommodate thermal expansion of the nozzle and base as the apparatus heats up. If the nozzle and base are of different materials, differential thermal expansion may be accommodated by the nozzle seal surface sliding against the force of the spring. A conventional heat-resistant gasket, well known in the art, may be used at the seal if desired, but generally it is not necessary.

Aside from the nozzle-base seal, nozzle designs may be of the type known in the art. For example, details of suitable nozzle designs for PFC are disclosed in U.S. Pat. No. 4,142,571 and are incorporated herein by reference.

To minimize thermal distortion, support elements are insulated from the crucible and nozzle. Further, the crucible support preferably includes cooling means. For example it may include channels through which a cooling fluid, such as water, may be passed. Cooling is more effective if these channels are inside the support; however, the channels may also be outside. For example, tubing in good thermal contact with the support may be used.

Particularly when the PFC method is used, the orientation of the nozzle outlet relative to the chill surface should be closely controlled and maintained. The present invention facilitates these objectives, even after the crucible is loaded, by providing separate supports for the nozzle and crucible and controlled loading forces at inter-element seals. The nozzle is held in place with an insulating retainer connected to a support bar. The insulating retainer is a light-weight insulator that holds the nozzle in place but does not consitute an appreciable heat sink. It is preferably of rectangular cross section and nests in a rectangular cutout in the support bar, thus permitting the bar to be used as a wrench for aligning or removing the nozzle, which similarly nests in the retainer. The wrench action is helpful, because there is a tendency for the nozzle to stick to the base.

It is desirable to be able to replace the nozzle while the crucible contains molten metal. This capability requires that flow from the crucible be interruptible with and without the nozzle in place. Establishing sub-atmospheric pressure above the molten metal in the crucible is one way to stop the flow out of the crucible. Alternative means for interrupting flow out of the crucible include a valve or a bottom tapping assembly, such as the well-known stopper rod tapping assembly. A preferred embodiment of that means includes within the stopper rod an interior vent for passing an inert gas from above the melt to the tapping orifice to permit flushing of the orifice between runs and thereby to prevent residue buildup. This preferred embodiment is disclosed in U.S. Pat. No. 3,964,535, issued June 22, 1976, to Bedell et al. When the apparatus includes a stopper rod, the nozzle-base seal is recessed below the top of the base to permit the rod to close off flow while the nozzle is in place.

The apparatus of the present invention is suitable for forming polycrystalline strip of aluminum, tin, copper, iron, steel, stainless steel and the like.

Metal alloys that, upon rapid ($\gtrsim 10^{5}$° C./s) cooling from the melt, form solid amorphous structures are preferred. These are well known to those skilled in the art. Examples of such alloys are disclosed in U.S. Pat. Nos. 3,427,154; 3,981,722 and others.

In the drawings, elements depicted in more than one figure have the same reference number in each.

FIG. 1 is a perspective view of an apparatus of the present invention showing a receptacle 10 attached at its lower end to base assembly 11 and at its upper end to cap 12. Metal in the receptacle is kept molten by heating means (not shown). The apparatus is supported by crucible support 13. Cap 12 and crucible support 13 have internal channels 14, 15, and 16 for passing cooling water.

Figure 2:
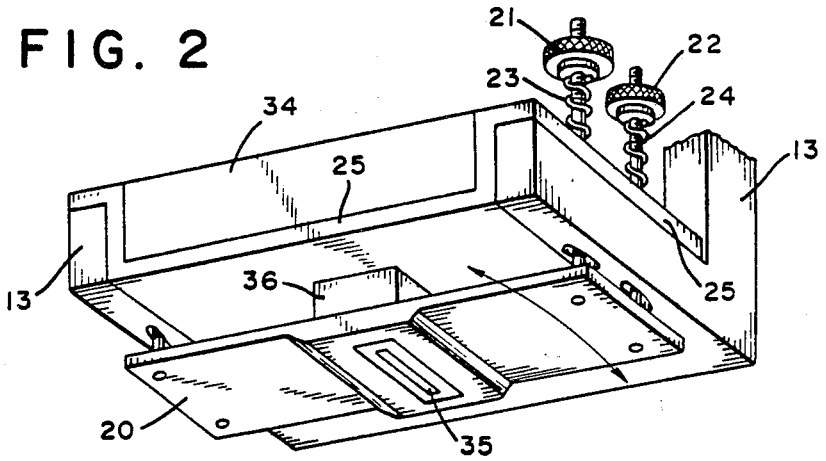
FIG. 2 is a perspective view of the bottom of the apparatus of FIG. 1.

FIG. 2 is a perspective view of the bottom of the apparatus of FIG. 1 showing nozzle support bar 20 attached to crucible support 13, with threaded fasteners 21 and 22. Fasteners 21 and 22 pass through radial slots to permit alignment and act against springs 23 and 24 respectively. The springs push against insulator support 25.

Figure 3:
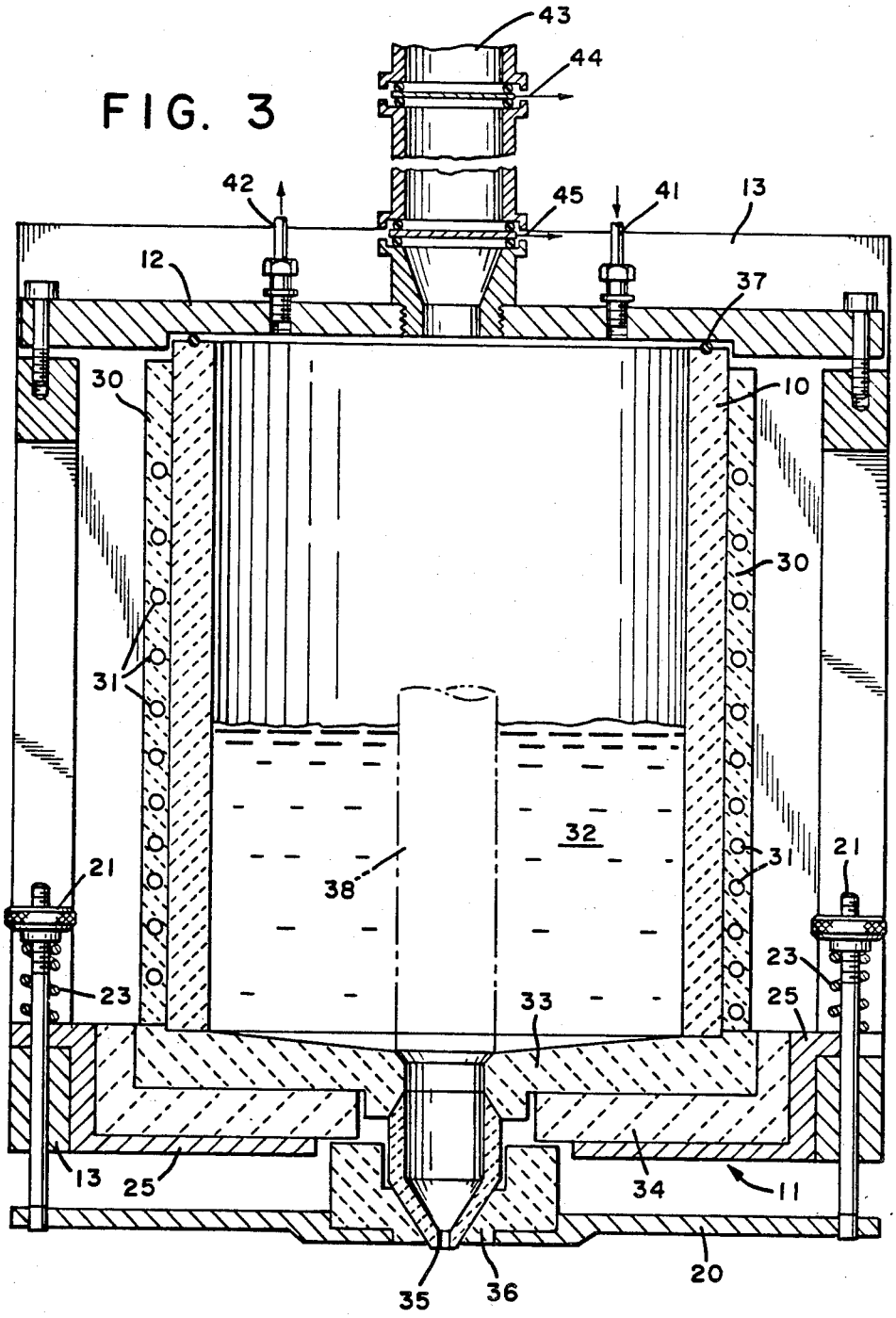
FIG. 3 is a vertical section through the apparatus of FIG. 1.

FIG. 3 is a vertical section through the apparatus of FIG. 1 showing receptacle 10 surrounded by tubular insulation 30, which encloses heating coils 31. Heating coils 31 maintain molten metal 32 above the melting point of the metal. Base 33 is insulated by base insulation 34 and nozzle 35 is insulated by insulating retainer 36. Cap 12 is sealed against receptacle 10 with gasket 37. Optionally, the cap mounting fasteners could act against springs in a fashion similar to that shown for the nozzle support fasteners. Flow from the crucible may be controlled by (optional) stopper rod 38. Gas may flow into and out of the crucible through optional inlet 41 and outlet 42. Additional metal may be introduced into the crucible during casting through passage 43. Valves 44 and 45 facilitate introducing metal without opening the crucible to the atmosphere.

Figure 4:
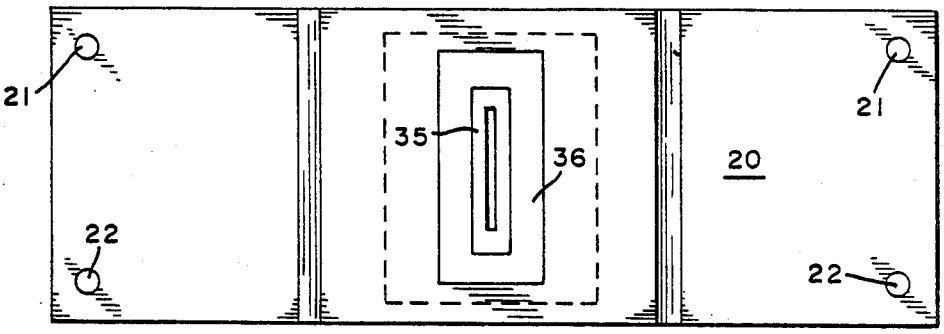
FIG. 4 is a bottom view of the apparatus of FIG. 1.

FIG. 4 is a bottom view of nozzle 35 in insulating retainer 36. The rectangular cross sections of nozzle 35 and retainer 36 and the rectangular cutout in nozzle support bar 20 permit the loosening of nozzle 35 in base 33 by rotating support bar 20 back and forth.

Figure 5:
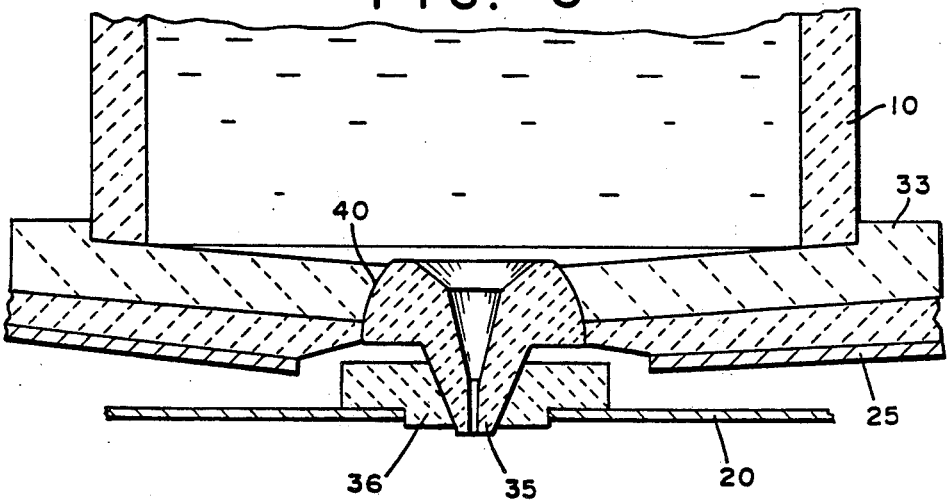
FIG. 5 is a vertical section through the lower part of a casting apparatus of the present invention that uses a ball-and-socket joint at the nozzle-base interface.

FIG. 5 shows the lower part of a casting apparatus in an embodiment wherein the nozzle-base interface is a ball-and-socket joint 40. This embodiment permits the nozzle 35 to be tilted relative to the base 33.

I claim:

1. A modular apparatus for casting molten metal onto a movable chill surface to form continuous strip, which comprises in combination:

(a) a crucible for holding the molten metal comprising
  (1) a receptacle having two open ends and
  (2) a separate base in sealing engagement with a first end of the receptacle and having a through passage,
(b) a cap member in sealing engagement with the second end of the receptacle.
(c) heating means for maintaining the metal in the molten state in the receptacle, and
(d) a nozzle having one end in sealing engagement with the base and providing, in communication with the through passage, a conduit for passing molten metal from the crucible into contact with the chill surface,
(e) means for stopping molten metal flow out of the crucible with or without the nozzle in place,
(f) crucible support means attached to the cap member and supporting the separate base, and
(g) resilient nozzle support means for supporting the other end of the nozzle and for providing controlled loading forces for the sealing engagements at the seals at the ends of the receptacle, and between said one end of the nozzle and the through passage of the base.

2. The apparatus of claim 1, further comprising means for cooling the crucible support.

3. The apparatus of claim 1 wherein the cap member has a through passage adapted to permit controlled gas flow into and out of the crucible.

4. The apparatus of claim 1 wherein the cap member has a through passage adapted to permit introduction of additional metal into the crucible during casting.

* * * * *